US006321872B1

(12) United States Patent
Parker

(10) Patent No.: US 6,321,872 B1
(45) **Date of Patent: *Nov. 27, 2001**

(54) SUPPORT DAVIT ARM FOR RETRACTABLE FALL PROCTECTION LANYARD

(76) Inventor: Michael Parker, 6601 Harrisburg Blvd., Houston, TX (US) 77011

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/161,972

(22) Filed: Sep. 28, 1998

Related U.S. Application Data

(63) Continuation of application No. 08/878,340, filed on Jun. 18, 1997, now abandoned.

(51) Int. Cl.[7] ..... A62B 35/00
(52) U.S. Cl. ..... 182/3; 182/142
(58) Field of Search ..... 182/3, 6, 82, 128, 182/8, 231, 239, 142

(56) References Cited

U.S. PATENT DOCUMENTS 1,133,429 * 3/1915 Christensen .
2,109,304 * 2/1938 Ormsby .
2,153,803 * 4/1939 Jerabek .
4,171,032 * 10/1979 Woolslayer .

FOREIGN PATENT DOCUMENTS

2637298 * 8/1976 (DE) .

OTHER PUBLICATIONS

Choose Sala, Machinery Center, Inc., prior 1994.*

* cited by examiner

*Primary Examiner*—Alvin Chin-Shue
(74) *Attorney, Agent, or Firm*—Browning Bushman

(57) ABSTRACT

The present disclosure sets forth a safety device for scaffolding so that workmen can climb up or down on the exterior of the scaffolding in safety. The apparatus includes an outwardly extending curving davit having an elevated and radially outwardly extending end supporting, at an eyelet, a fall arrester. The fall arrester is anchored with a hook and an eyelet and has an elongate cable of adequate length extending down to a hook connecting with a D-ring on a body harness for a user. If the user falls, the fall arrester sets a brake preventing the cable from extending, thereby interrupting the fall of the workman.

7 Claims, 2 Drawing Sheets

SUPPORT DAVIT ARM FOR RETRACTABLE FALL PROCTECTION LANYARD

This is a continuation of application Ser. No. 08/878,340 filed on Jun. 18, 1997, now abandoned.

BACKGROUND OF THE INVENTION

In construction of a multi-story building, it is necessary to work on the building from the exterior. This is especially true when covering the exterior with a brick veneer constructed from the ground up. It also typically is required to affix window frames, awnings and gutters. It is not uncommon to erect a scaffolding which is the length of the building. Indeed, it is not uncommon to put scaffolding around a building which completely encircles the building. If the building has a rectangular shape of 50 feet by 100 feet and stands 50 feet tall (not uncommon for a four story building), the aggregate length of the scaffolding will represent 300 linear feet on the surface standing 50 feet tall. Personnel often are required to climb up the scaffolding. Sometimes, they can climb on the interior. Often, however, they must climb on the exterior of the scaffolding. This is dangerous to personnel who may slip and fall off the scaffolding. When they fall from the outside face of the scaffolding, they typically will fall onto construction equipment, stacked raw materials and many other things. The injuries from the fall are compounded by the irregular surface area. Moreover, when such a fall occurs, it typically happens when the workman is climbing up the side of the scaffolding and topples over backwards onto his back. The present disclosure is a safety device which protects against this kind of fall. This is true, for buildings, and also tall petrochemical plants.

In protecting the workman climbing on the outside face of scaffolding, the present disclosure sets forth a safety device which is rigged on the scaffolding. It is customary for the scaffolding to be erected from level to level. For instance, the scaffolding is erected to a height enabling construction on the second floor. Then, it is extended up to the third floor as the work proceeds up the building. As it is extended to match the height of the building, or at least approximately so, the additions to the scaffolding enable the workmen to climb up the side. The present disclosure sets forth an overhead device supported on the scaffolding and is directed to an overhead device which supports the workman. Moreover, it is a protective system which enables the workmen to climb up and down the exterior of the scaffolding. While climbing occurs, the workmen are tethered to this apparatus and are protected against falling.

It is such a matter of chance that the fall can be insignificant in many instances and yet can create bodily injury, even death in other instances, from the same height. It is not uncommon for workmen to fall 15 or 20 feet and walk away with no injury. Just as tragically, the same height fall can be fatal to some workmen. It is that irregular risk, wholly unpredictable, that accents the danger and harm that might arise with a fall. When downward movement increases as would occur at the start of a fall, the tether connected to the workmen arrests the fall and holds the workmen. This involves an overhead davit which extends out over the top edge of the scaffolding to extend a cable of sufficient length to reach down to the workmen. The cable is grabbed by the workmen and then latched to a connective ring on a body harness worn by the workmen. The body harness includes appropriate straps so that all the weight of the workmen hangs on the tether line extending from above. Accordingly, as the workmen travel up or down on the exterior of the scaffolding and should fall, the fall is arrested and injury is prevented.

The present disclosure is directed in particular to a demountable davit. It is desirable to mount it at a particular height above on the top edge of scaffolding. Eventually, however, the scaffolding will be extended upwardly by another row of scaffolding members, thereby raising the height. The device of the present invention is detached and remounted. It is moved to the new upper level. As it is moved, it enables workmen on the exterior of the scaffolding to be protected at all times and at greater heights. Again, it is not uncommon to erect the scaffolding as much as 100 feet; even at that height, the workmen can be protected. As one would further understand, as the height of the scaffolding becomes greater, the chance of merely walking away from the fall becomes quite small above about 20 or 30 feet. Indeed, fatal injuries have occurred even at lower heights but they are substantially guaranteed at heights above about 30 or 35 feet. The present apparatus is summarized as comprising an overhead davit which extends outwardly. It has a mounting mechanism which attaches to an upright member of the scaffolding. It is attached by multiple clamps. At the distal end of the davit, there is a reinforced eyelet which supports a retractable tether line equipped to latch on falling. The tether line connects with a harness worn by the workmen. The body harness supports the weight of the workmen.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF THE PREFERRED EMBODIMENT

Figure 1:
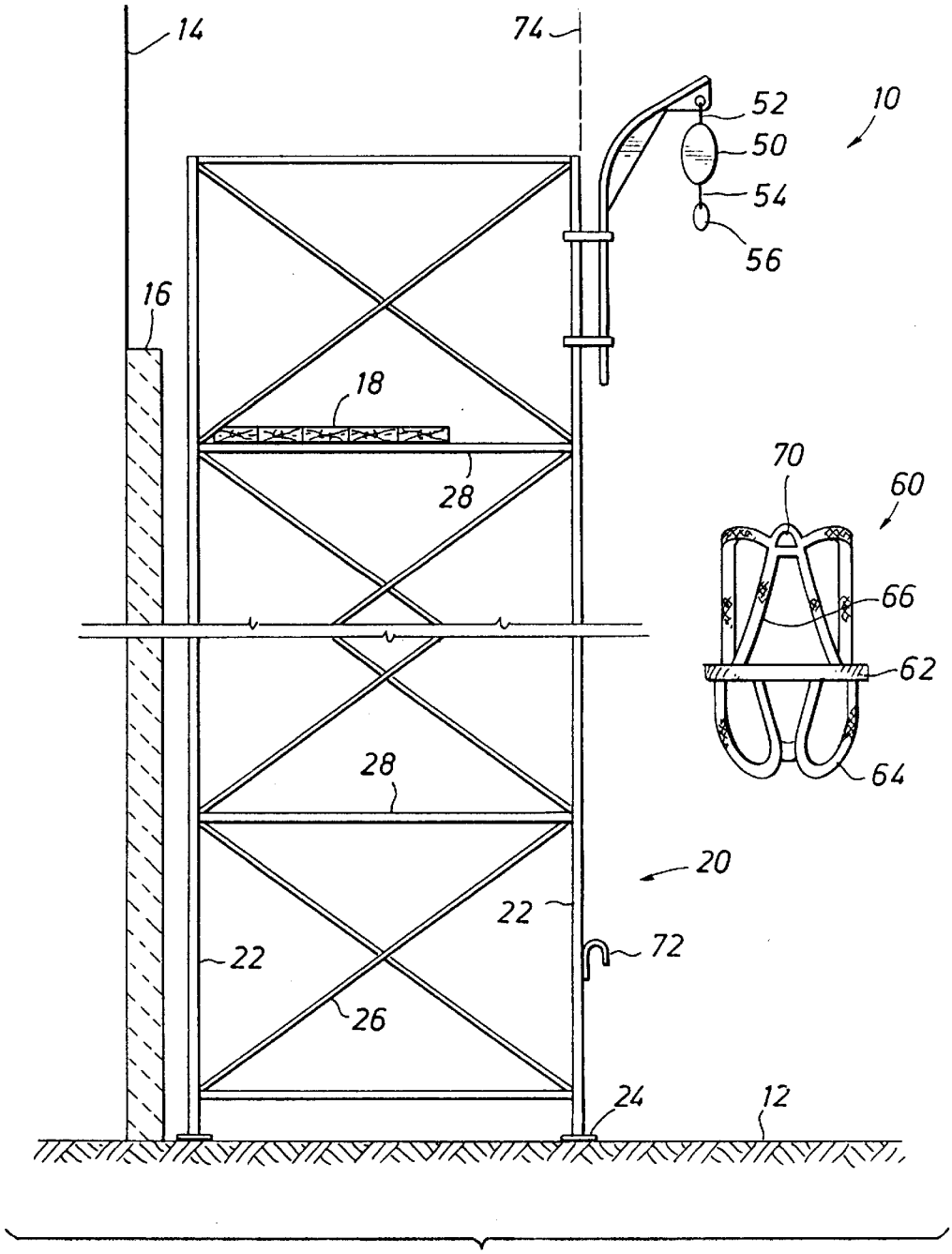
FIG. 1 is a side view of the davit mounted safety system of the present disclosure installed on a multi-story scaffolding system and illustrates the laterally extending overhead davit in conjunction with a full body hardness worn by a user.

Attention is first directed to FIG. 1 of the drawings where the numeral 10 identifies the present invention which is attached to a scaffolding system. To put the device 10 in context, the description will digress momentarily to the construction site so that the context will be more readily understood. The context begins at the ground 12 which is marginally located around the face of a building 14. The building 14 can be any height, and for purposes of illustration, it will be discussed in the context of a brick veneer building which incorporates a partially completely brick veneer 16 which extends upwardly to the illustrated height, assumed to be the height of the third floor. The scaffolding at different levels will support temporarily installed horizontal planking 18 such as a set of 2×8's which are shown. These provide temporary decking for the brick layers. Other craftsmen will typically use this also. It is temporary in the sense that it is laid for the moment on the scaffolding to be described. It is placed at this location temporarily and will ultimately be moved to a higher location as the course of bricks raises the brick veneer. The brick veneer 16 is continued until some limitation is encountered. Then, the planking 18 will be disassembled and raised to a greater height in the scaffolding. This is continued indefinitely until the scaffolding extends to the top most height required for building construction. At that juncture, the building is then finished, the planking 18 is removed, and the scaffolding is disassembled. Again, FIG. 1 shows a building but the system can be installed adjacent to a silo, tank, distillation column and the like.

The scaffolding is indicated generally by the numeral 20. It incorporates a set of vertical legs 22 which terminate at appropriately mounted feet 24 resting on the ground. The feet 24 level the scaffolding so it is erected vertically and parallel to the building 14. The legs 22 are installed at two rows, one row being right next to the building and the second row is located in parallel fashion but spaced out from the building and is the outer leg. The legs 22 are symmetrically constructed as illustrated in FIG. 1. Diagonal braces 26 are incorporated. The diagonals in particular serve the function of maintaining the parallel stability of the legs 22. Periodically, the parallel frame members are additionally reinforced by a horizontal scaffolding member 28. The horizontal member connects with appropriate connectors in the legs so that the scaffolding can be assembled repetitively to achieve the required height. The horizontal bar 28 serves as a floor support for the planking 18 which is shown further up the scaffolding. Other aspects of the scaffolding need not be illustrated. It is, however, noted that the scaffolding is installed so that it is self-supporting and stabilized. If the scaffolding is erected along a single wall, caution must be exercised to stabilize the scaffolding by attaching the scaffolding to a number of guy wires to assure that it does not wobble. Where the scaffolding is arranged along two, three or four sides of a building, stability is enhanced by connecting the scaffolding on the multiple side walls of the building so that the scaffolding is a continuous member extending around the corner, so to speak. This helps stabilize the scaffolding against toppling.

Assume for purposes of illustration that the scaffolding shown in FIG. 1 extends 40 feet high and the planking 18 is located at a height of 35 feet. The vertical legs 22 are shown as a continuous line but it will be appreciated that they are ordinarily assembled out of individual shorter joints which are threaded to mating couplings. Details of this sort have been omitted from the drawings because they are believed to be well known and understood in the art.

Figure 2:
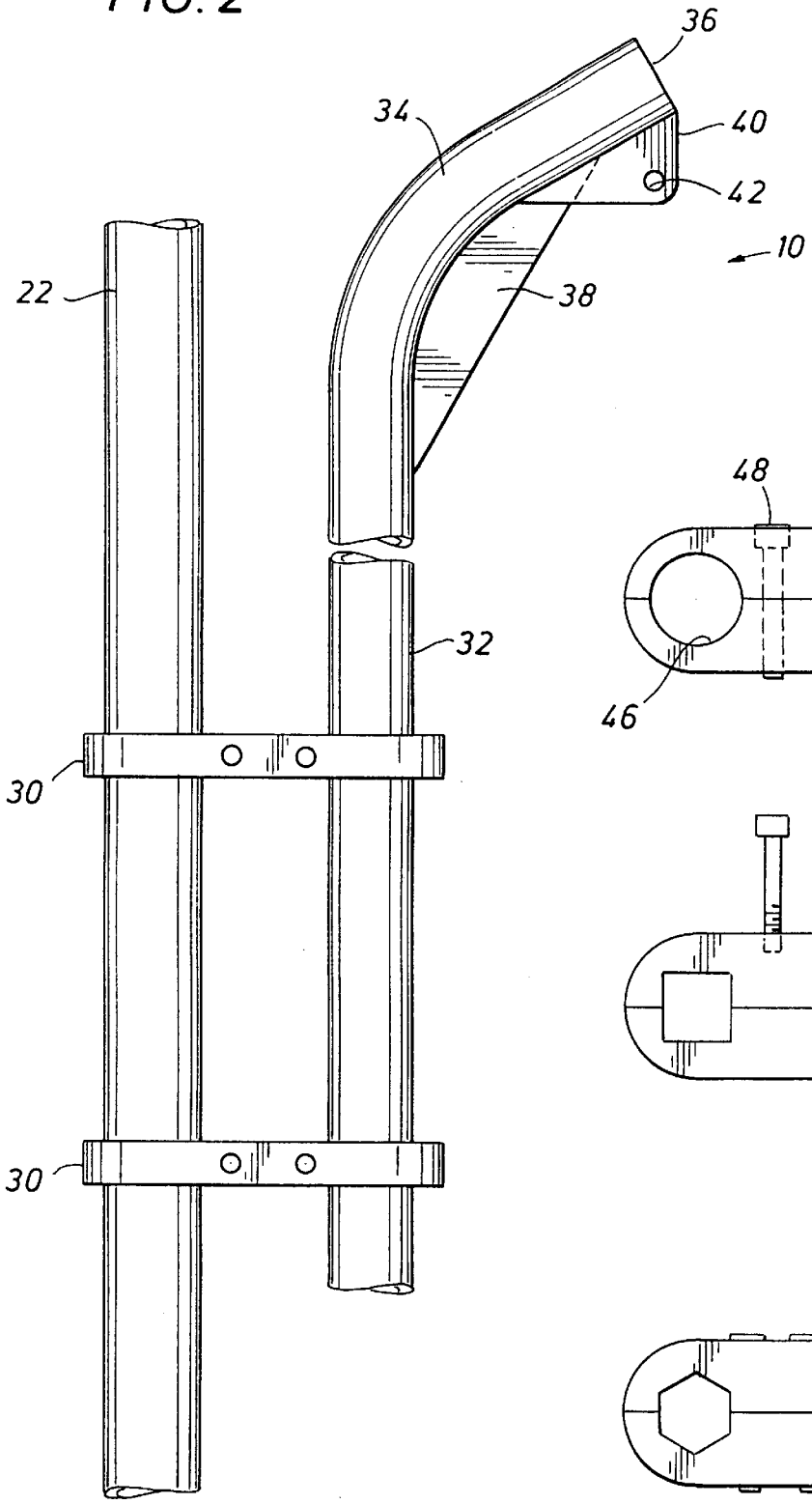
FIG. 2 is an enlarged detailed view of the davit which extends outwardly and above the scaffolding.

The outer leg 22 is used to support the davit structure. This is better shown on reference to FIG. 2 of the drawings. There, the leg 22 is shown at the left side and is the vertical anchor member. Anchoring is accomplished through the use of at least a pair of protruding horizontal clamps 30. At least two and sometimes three clamps can be attached to hold the vertical curving davit. FIG. 2 therefore illustrates the upstanding tubular davit which includes the vertical portion 32 and the curved portion 34. The distal end 36 defines the termination of the davit. This is located where it hangs out over the edge of the scaffolding by approximately 8 to 30 inches. The curved portion extends upwardly at an angle between about 20 and 40°, the preferred angle being an angle of about 30°. The davit is formed of a bent pipe having a nominal diameter of at least about two inches to about three inches. The davit under the bent portion 34 is protected by a gusset plate 38 which is cut to match the contour of the curving pipe 34 and is welded in the curvature. At the distal end, a triangular support gusset 40 is incorporated. A fastener eyelet 42 is formed in it.

Figure 3:
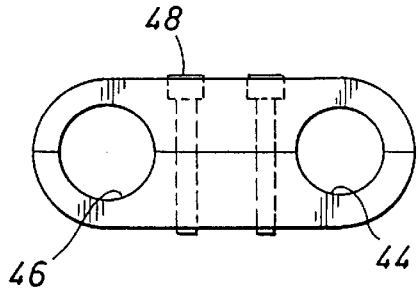
FIGS. 3, 4 and 5 show different types of clamp mechanisms for attaching the davit on the scaffolding.
Figure 4:
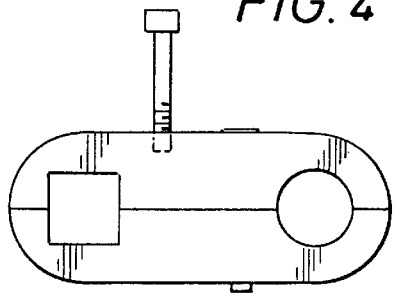
Figure 5:
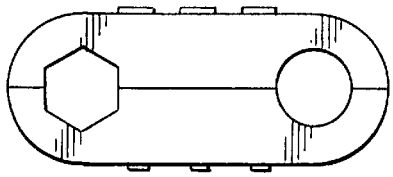

FIGS. 3, 4 and 5 show alternate forms of the clamp. Going specifically to the clamp 30 shown in FIG. 3, it incorporates symmetrical halves and is constructed with a davit clamp opening 44. At the other end, an opening 46 is formed so that the pipe leg 22 can be snugly clamped. Two or sometimes three heavy gauge bolts 48 are used to pull the two halves together so that the clamp mechanism holds firmly to both of the clamped members. The fit should be snug so that the clamp does not slide after fastening.

FIGS. 3, 4 and 5 show different constructions of clamps. FIG. 4 is illustrated to clamp around a rectangular or box leg. FIG. 5 differs in that it shows a leg formed of six sided tubing. In some instances, the clamp will be required to fasten to a H-beam. While the variety of leg shapes for the scaffolding can be accommodated, it is desirable primarily that the opening 46 snugly grip and hold against the scaffolding leg.

The several clamps shown in FIGS. 3, 4 and 5 also illustrate variations in scale which can be implemented. As an example, the openings 44 and 46 can be the same diameter but they can differ in size. Likewise, two or three fasteners can be used. The clamps are preferably constructed with sufficient thickness that they do not bend of flex, and they are further constructed to assure certain clamping at the openings 44 and 46. Those inside surfaces can be made rough; for example, at the time of fabrication, the openings 44 and 46 can be knurled on the inside to assure a firm grip.

Two or three of the clamps are attached to hold the davit in place. The davit is rotated so that it extends at right angles to the scaffolding 20. This locates the distal end 36 at an extended location outwardly of the scaffolding. In terms of fabrication, the gusset 38 is contoured to the curvature and has a thickness so that it assures relative stiffness. The welded member 40 is best installed with more than simply a weld along the bottom side of the curving davit pipe 34. Preferably, the end of the pipe is split so that the member 40 is inserted into the split. It is then welded on the inside of the pipe at the distal end 36 as well as forming left and right beads on the exterior of the pipe 36. This assures an enhanced connection between the two components.

Attention is now directed to the tether system in FIG. 1 which includes a fall arrester. One such device is provided by the Aros firm and is known as a retractable life line. The model is the G-Series. Continuous tension of a specified amount permits cable to be spooled in or out. The fall arrester 50 includes an upper connective link 52 which is preferably a ring or hook fastening through the eyelet 42 previously mentioned and illustrated in FIG. 2. The fall arrester 50 encloses a retractable steel cable. Cable lengths ranging from about 20 to about 120 feet are spooled in the equipment. The cable 54 extends downwardly to a fastening ring 56. Briefly, the device permits the cable to be pulled in or out at a constant but safe velocity. If the cable is pulled downwardly at an increasing velocity, an inertial disk pad braking system is operated to retard cable extension, and arrest downward movement. The system can be adjusted so that the length of the fall is quite short. To avoid jerking the workmen violently, it is desirable that the fall arrester 50 slow down and retard the fall of a workman. To this end, if a workman starts falling, the deceleration leading to absolute stoppage occurs in an adjustable distance and it is preferably about 2 to 4 feet. This assures that the workman is caught quickly and not bounced around, hanging next to the exterior of the scaffolding 20. The workman is connected with the hook 56 by means of a body harness 60. The body harness 60 includes a belt 62 and leg straps 64 which loop around and under both legs. It is illustrated from the back in FIG. 1 and incorporates upwardly extending suspenders 66 which terminate at a D-ring 70. The D-ring connected to the harness holds the entire weight of the person. The D-ring 70 transfers the weight of the workmen to the fall arrester 50.

The device is used in the following manner. The davit is installed at the raised elevation shown in FIG. 1 of the drawings with the fall arrester 50 suspended from the outer end. The hook 56 is engaged and is pulled downwardly, thereby extending the cable 54. If need be, a convenient hook 72 is located on one of the legs near the bottom to simply locate and tie off the cable 54 at a convenient height near the ground. For use, the workmen puts on the full body harness 60. The hook 56 is engaged with the D-ring 70. While the hook is shown in schematic form, it will be appreciated that it is a closed hook which latches onto the D-ring and holds without risk of accidental disengagement. At this point, the workmen is then able to start climbing up the exterior of the scaffolding 20. As the workman climbs, the fall arrester spools in the cable 54. It is stored on a drum or reel which is integral to the fall arrester. As a generalization, the cable is spooled in or out at a controlled minimal velocity. Whether going up or down the scaffolding, the fall arrester cable is maintained taut. The brake in the device is adjusted so that this rate of movement is permitted.

Assume that the workman accidentally falls from the scaffolding at a dangerous height. Immediately, the cable 54, initially taut, is pulled more rapidly from the fall arrester 50. When it reaches the set velocity, the inertial brake is applied to the drum and the drum is stopped. The fall of the workman will be just two or three feet before the weight of the workman is held fully by the tethered cable 54. It is not uncommon that the workman will bounce and swing to and fro. Even if the workman is rotated, the swinging to and fro of the workman on the tethered cable accompanied by rotation will typically spin the workman around so that the workman is able to reach over and grab the leg 22 of the scaffolding, and pull himself back to safety. Once back safely climbing the scaffolding, the workman can then climb upwardly for just a moment, thereby releasing the inertial brake. This will then enable the workman to finish climbing to the top or bottom of the scaffolding as desired.

The scaffolding might thereafter be extended to greater heights. To raise the scaffolding to a greater elevation, scaffolding erection simply continues upwardly as desired. Once the height of the scaffolding is enhanced, typically adding another story in height, the safety apparatus 10 of the present disclosure is momentarily dismounted. This can be done safely by a workman who is located inside the scaffolding and standing on the planking 18. If desired, the planking can be moved up to another level also. In a safe manner, the clamps 30 are disengaged and the outwardly extending safety davit is then raised to the next height. This requires reinstallation of the two clamps.

If the scaffolding system around the building is quite long, safety davits of the sort shown above are located at several locations. This makes the use of the safety equipment much more convenient for workmen. Typically, two or three different harnesses 60 may be required in the area. If desired, the hook 72 can be used for a convenient hook for the safety harness 60 as well as the cable 54 pulled down from the fall arrester 50.

While the foregoing is directed to the preferred embodiment, the scope is determined by the claims which follow.

What is claimed is:

1. In combination with scaffolding mounted alongside a building for erection in sequence in a plurality of vertically spaced sections and having vertically extending outer tubular legs, the scaffolding including horizontal planking for supporting a workman and arranged for disassembly and mounting at increased heights of the scaffolding upon addition of an upper section of scaffolding;

fall protection apparatus comprising a davit mounted on a selected outer tubular leg for adjustable vertical movement along said selected leg and positioning at a desired vertical location adjacent said planking on an upper section of said scaffolding;

said davit including a vertical portion extending in parallel relation to said selected outer tubular leg on the planking, and an upper curved end portion extending outwardly from said vertical portion at an angle between 20 degrees and 80 degrees between and extending outwardly from said scaffolding between about 8 and 30 inches;

a reinforcing member secured between said vertical portion and said curved end portion across the angle between said vertical portion and said curved end portion;

a gusset plate secured to said curved end portion adjacent the extending end of said curved end portion and extending downwardly from said curved end portion;

an eye extending through said gusset plate;

a pair of clamping devices spaced vertically from each other for releasably clamping said vertical portion to said selected outer tubular leg to permit sequential adjustment of said davit at selected heights along said outer tubular leg for positioning said davit adjacent said planking on the upper section of said scaffolding;

a body harness; and a fall arrestor positioned outwardly of said scaffolding and extending between said eye and said body harness for supporting the workman from said davit.

2. The fall protection apparatus as defined in claim 1 wherein said vertical portion of said davit includes a lower anchor portion, and said clamping devices releasably connect said lower anchor portion to said outer tubular leg.

3. The fall protection apparatus as defined in claim 2, wherein each of said clamping devices is movable between an open position to release said davit from said outer tubular leg and a closed position to releasably connect said davit to said outer tubular leg.

4. The fall protection apparatus as defined in claim 1, wherein said fall arrestor has an extendable cable supported from said eye and is connected to said body harness.

5. The fall protection apparatus as defined in claim 1, wherein said davit comprises a pipe defining said vertical portion and at an angle between 20 degrees and 40 degrees there between.

6. The fall protection apparatus as defined in claim 5, wherein said reinforcing member is welded to said vertical portion and to said upper curved end portion.

7. The fall protection apparatus as defined in claim 6, wherein said gusset plate is welded along the lower surface of said upper curved end portion.

* * * * *

UNITED STATES PATENT AND TRADEMARK OFFICE

CERTIFICATE OF CORRECTION

PATENT NO. : 6,321,872 B1
DATED : November 27, 2001
INVENTOR(S) : Michael Parker It is certified that error appears in the above-identified patent and that said Letters Patent is hereby corrected as shown below:

Title page, Item [54 and Column 1, line 2,
Delete "PROCTECTION" and insert -- PROTECTION --.

Column 6,
Line 19, delete "80" and insert -- 40 --.
Line 19, delete "between" and insert -- therebetween --.
Lines 56 and 57, delete "at an angle between 20 degrees and 40 degrees there between" and insert -- said upper curved end portion --.

Signed and Sealed this

Sixteenth Day of July, 2002

*Attest:*

*Attesting Officer*

JAMES E. ROGAN
*Director of the United States Patent and Trademark Office*